United States Patent [19]

Jones et al.

[11] 4,081,929

[45] Apr. 4, 1978

[54] VIBRATORY MILL WITH DRAINAGE AND CLASSIFYING MEANS

[75] Inventors: George F. Jones, Mishawaka; Raymond M. Leliaert, South Bend, both of Ind.

[73] Assignee: Wheelabrator-Frye, Inc., Hampton, N.H.

[21] Appl. No.: 748,780

[22] Filed: Dec. 9, 1976

[51] Int. Cl.[2] ..... B24B 31/00
[52] U.S. Cl. ..... 51/163.2
[58] Field of Search ..... 51/163.1, 163.2, 7

[56] References Cited

U.S. PATENT DOCUMENTS

| | | | |
|---|---|---|---|
| 3,071,900 | 1/1963 | Balz | 51/163.1 |
| 3,407,542 | 10/1968 | McKibben | 51/163.2 |
| 3,724,146 | 4/1973 | Fahey | 51/163.2 |

FOREIGN PATENT DOCUMENTS

| | | | |
|---|---|---|---|
| 2,238,188 | 9/1973 | Germany | 51/163.2 |

*Primary Examiner*—Harold D. Whitehead
*Attorney, Agent, or Firm*—McDougall, Hersh & Scott

[57] ABSTRACT

A bowl type finishing mill embodying a dam extending crosswise of the bowl in advance of a separating screen with drainage means provided in the approach to the dam for the removal of fluids, dust, fines and undersized particles from the system.

5 Claims, 5 Drawing Figures

FIG. 1
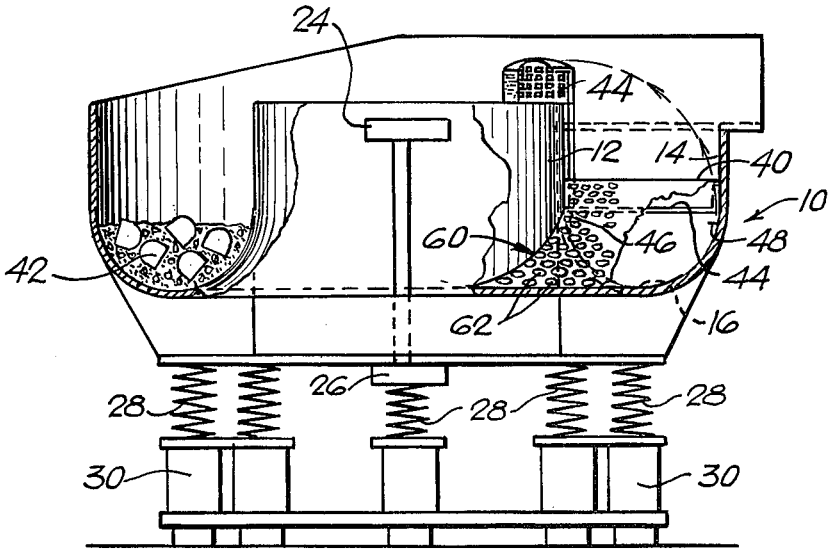
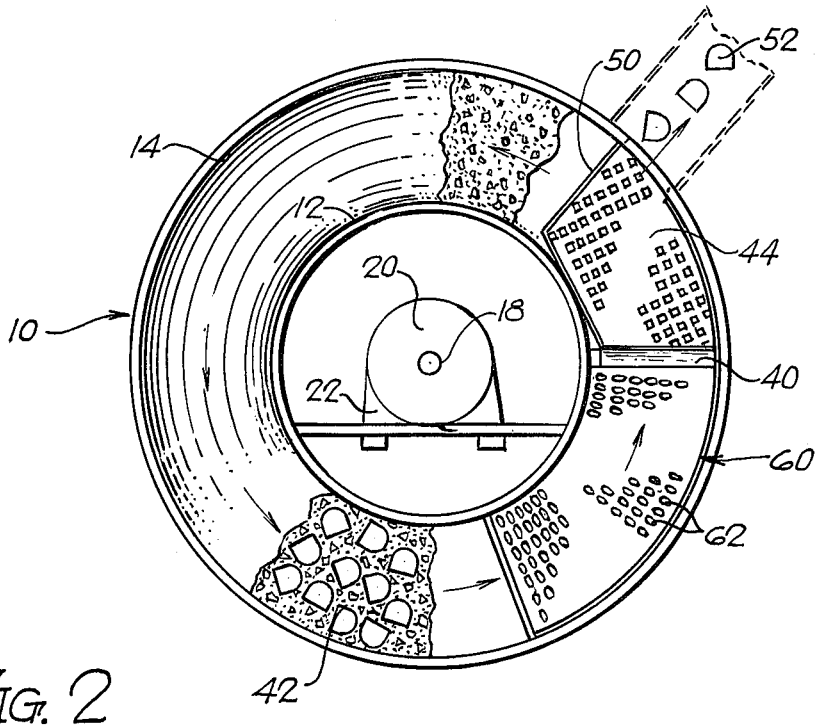
FIG. 2

VIBRATORY MILL WITH DRAINAGE AND CLASSIFYING MEANS

This invention relates to a vibratory finishing device in which parts to be finished and media are subjected, in admixture, to vibratory action for the purpose of polishing, deburring, or otherwise finishing said parts.

Parts to be finished comprise a wide variety of articles, including metal castings, molded plastic parts, and the like articles of manufacture, and the media may comprise an abrasive or polishing material such as granite, aluminum oxide, sand, chipped marble, steel bars, and molded plastic pellets of smaller dimension than the parts and which also may beneficially contain a fluid or finely divided polishing material in admixture with the media to form a part thereof.

When the parts and media are vibrated in admixture in said vibratory device, the resulting action causes the surfaces of the parts to be rubbed in a polishing, abrasive or abrading action.

For the most part, such vibratory devices comprise annular containers having a curvilinear bottom wall with axially spaced inner and outer side walls extending upwardly continuously from the ends of the bottom wall, with springs or other resilient means supporting the container to enable vibratory movements in response to rotation of one or more eccentrics distributed along the axis of the container. An elliptical movement is imparted to the parts and media for travel continuously down one side wall across the bottom and up the other side wall and back across the the top as the parts and media are advanced circumferentially about the container. By reason of the circular configuration of the container, the parts and media can be allowed to recirculate in the manner of a continuous operation, in response to such vibratory movement, until the desired surface treatment or finishing operation has been completed.

In the copending application of one of us and commonly owned, filed concurrently herewith and entitled "Vibratory Finishing Device", which application is incorporated herein by reference, description is made of a vibratory device of the bowl type in which a dam is placed across the trough to extend upwardly a short distance from the bottom wall. The mixture of parts and media are backed up by an amount gradually to build up the parts and media to a level above the normal level in order to pass over the dam, with a drop-off of the level to far below the normal level upon clearance of the dam. A separating screen extends from the dam at a level below the normal level for the mixture of parts and media to effect separation thereof and return of the media by gravity to the trough for continued circulation about the bowl.

As previously described, a liquid component is often added to the mixture of parts and media to assist in the surface treatment during vibratory movement. In addition, media slowly breaks down by attrition into dusts and particles of a dimension unsuitable for continued use as media in the treatment of parts. It is therefore desirable to provide means for removal of the liquid and fines from the material being circulated about the trough and to prevent the build-up of dusts and material removed from the parts during processing.

Thus, it is an object of this invention to provide a means for the removal of liquid, dust, dirt, and fines from the media or the mixture of parts and media, and it is a related object to provide a means and method for classifying the media for removal of undersized components during circulation about the bowl of a vibratory device.

These and other objects and advantages of this invention will hereinafter appear, and, for purposes of illustration, but not of limitation, embodiments of the invention are shown in the accompanying drawings, in which:

FIG. 1 is a schematic sectional elevational view of a vibratory device embodying the features of this invention;

FIG. 2 is a top plan view of the device shown in FIG. 1;

Figure 3:
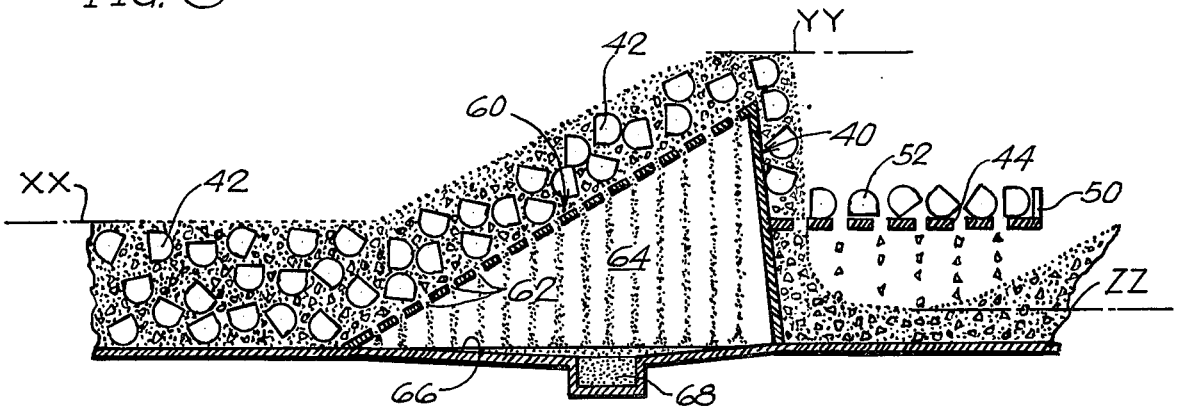
FIG. 3 is a sectional view taken along the line 3—3 of FIG. 2.

In the drawing, illustration is made of a vibratory device embodying the features of this invention, including a circular bowl 10 having a cross section in the form of a channel which is open at the top and is formed of a pair of axially spaced cylindrical sections that represent the side walls 12 and 14 of the bowl and which are joined at their lower ends by a curvilinear bottom wall 16.

A shaft 18 extends along the vertical axis of the bowl with means mounting the shaft for rotational movement, as by a variable speed motor 20 that is mounted by means of a suitable bracket 22 to the bowl 10 or frame. Eccentric weights 24 and 26 are fixed in vertically spaced-apart relation along the shaft 18 to impart vibratory movement to the bowl in response to rotational movement of the shaft. The bowl, its supported motor, eccentrics, and shaft, is supported by a plurality of circumferentially spaced coil springs 28 on a base 30 to enable vibratory movement of the bowl relative to its support. During the finishing treatment, the parts and media in the bowl are caused to travel in an elliptical or orbital path in one direction about the bowl in response to the vibratory action.

As described in the aforementioned copending application, extending upwardly from the bottom wall of the trough, for a distance preferably greater than one-half the depth of the normal level of parts and media processed in the trough but less than said normal level (corresponding to approximately one-fourth to approximately two-thirds of the height of the trough), is a dam 40 which extends crosswise of the trough.

During movement of the media and/or parts in its orbital path about the bowl, responsive to vibratory action, the dam 40 causes the parts and media, indicated by the numeral 42, to pile up whereby the level gradually increases in advance of the dam to a level YY as the parts and media clear the dam. Upon clearance of the dam, the level falls off precipitously to a level ZZ which is below the normal level XX of the parts and media. Thereafter the particulate components gradually increase to the normal level XX as the parts and/or media continue to circulate about the bowl.

A separator 44, in the form of a screen member, is mounted for rocking movement about a pivot 46 between a raised position out of the path of the material clearing the dam, to a lowered position determined by a stop 48 on which the free end of the screen 44 rests to extend horizontally crosswise of the trough into the path of the material clearing the dam 40 but at a level below the apex of the dam, and preferably below the level XX but above the level ZZ. Thus the particulate material is deposited on the surface of the screen 44 as it clears the dam 40. The openings in the screen 44 are dimensioned to retain the parts of larger dimension on the surface thereof while the smaller particles, including the media, dust, and dirt, sift through the screen and fall gravitationally into the underlying portions of the trough for continued circulation about the bowl.

The screen 44, which is dimensioned to have a length to terminate before the length of the media rises again to the level of the screen, is provided with a deflector 50 which extends angularly or curvilinearly across the top surface to guide the separated parts 52 through an aligned opening in the side wall of the trough for delivery of the separated parts.

An important feature of this invention resides in the means and method incorporated in a vibratory device of the type described for the removal of liquid component employed with the media, for removal of fines and dusts generated by attrition of the media and derived from the surfaces of the parts during processing, and to classify the media to maintain its effectiveness by removal of any undersize.

For this purpose, the approach to the dam 40 is provided in the form of a ramp 60 which extends crosswise of the trough and which is gradually tapered to extend at an angle of about 15° to 40° from the bottom wall of the trough to the apex of the dam. Openings 62 are provided through the ramp dimensioned to permit liquid with entrained fines and dusts to drain therethrough while the particulate material of larger dimension, including the media and parts, continue in the normal manner to pass over the dam. Location of the drain openings in the floor leading to the dam takes advantage of the rise of the particulates and the interaction between the particulate materials as they press against the floor during their rise to clear the dam. Thus the rise to the dam enhances the drainage of liquid with entrained fines and dusts and enables tneir removal at a most appropriate stage of the cycle of operations.

The area immediately below the ramp 60 is in the form of a compartment 64 having a tapered bottom wall 66 which leads to a drain 68 for removal of collected liquid from the device.

Figure 4:
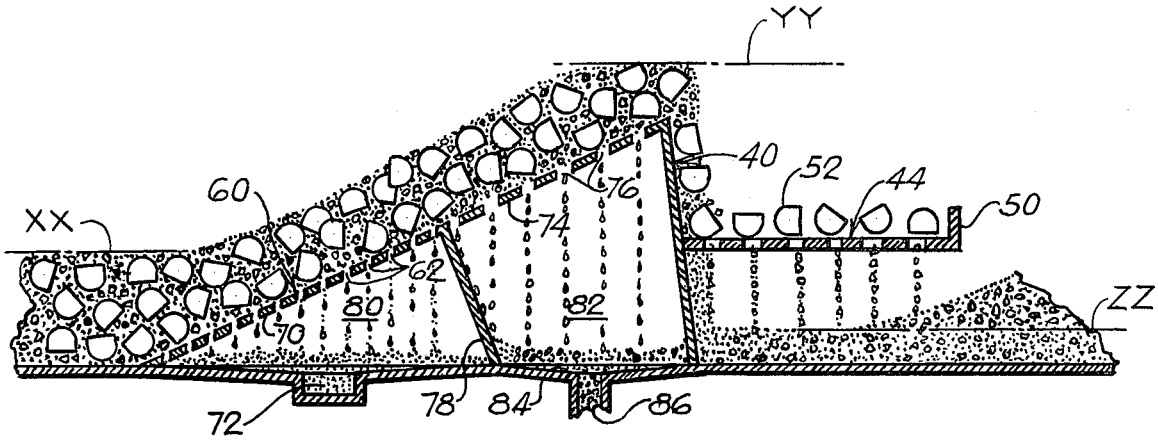
FIG. 4 is a sectional view similar to that of FIG. 3 showing a modification in the device.

In the modification shown in FIG. 4, the ramp 60 is divided into a lower portion 70 having openings of a dimension to enable liquid and entrained fines and dusts to drain therethrough into an underlying compartment 80, while the upper portion 74 is provided with openings dimensioned to enable passage therethrough of broken-down and undersized media which are no longer suitable for use as a media. The area immediately beneath the ramp 60 is correspondingly divided by separator wall 78 into a compartment 80 for receiving the liquid and entrained fines flowing through the openings 62, and compartment 82 which receives the undersized and broken-down media. The bottom walls of the latter compartment are tapered to form a hopper 84 for collecting the particulate material entering into the compartment. The hopper 84 is provided with an outlet 86 at its base to enable the removal of material collected therein.

Figure 5:
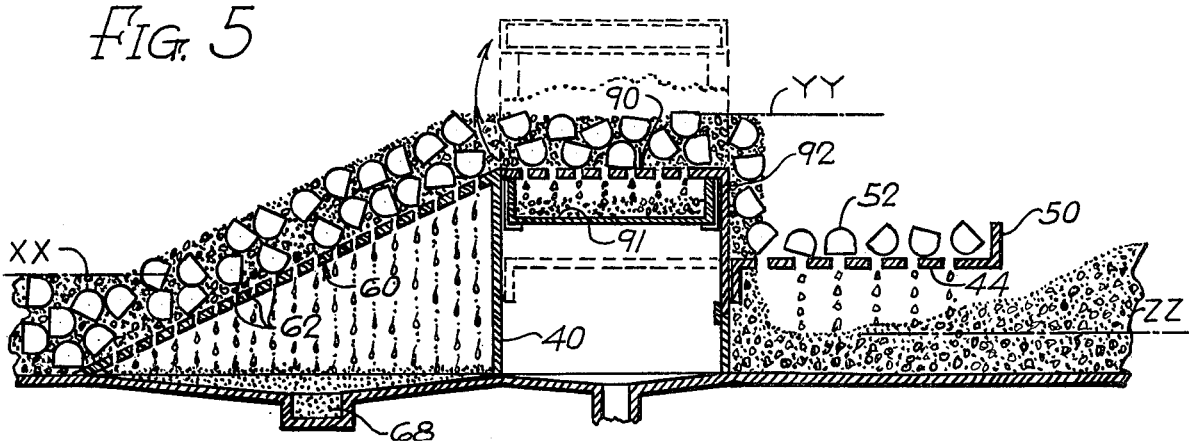
FIG. 5 is a sectional view similar to that of FIG. 3 showing a still further modification.

In the modification shown in FIG. 5, the classifying screen 90 is mounted as an element separate and apart from the ramp 60 for crosswise rocking movement about a hinge 92 between raised position, out of the path of the particulates circulating about the bowl, to a lowered position to extend horizontally from the dam 40 at a level coressponding to its apex. Thus the screening member 90 can be maintained in an inactive position until such time as it is desirable to classify the media for the removal of broken-down and undersized media. A pan 91 is associated with the classifying screen, in spaced relation with the underside thereof but movable therewith to receive the broken-down or undersized media passing through the screen for delivery to an opening (not shown) in the side wall alongside the pan. Such classification can be carried out as a separate operation while media only is being circulated about the bowl, or it can be carried out during processing of the parts and media. Under the latter circumstance, the separating screen 44 would be located downstream of the classifying screen 90.

In practice, the media is loaded into the bowl and parts are added as the bowl is vibrated. Until such time as the finishing operation has been completed, the screen 44 is maintained in its raised position so that the parts and media will continue to circulate about the bowl while being subjected to vibratory action. The parts and media will rise to greater depth in advance of the dam 40 and fall to a lower level upon clearance of the dam, after which they will rise gradually to normal level during subsequent flow about the bowl.

When the finishing operation has been completed, the screen 44 is inserted into position of use immediately beyond the dam, whereby the parts and media overflowing the dam are deposited on the surface of the screen. In response to continued vibratory movement, the parts remain on the surface of the screen while the media sifts therethrough and falls gravitationally into the underlying portion of the trough. In the meantime, the parts are displaced over the surface of the screen to the delivery opening.

Thereafter, new or other parts can be added to the media in the bowl for another cycle of operation.

In the meantime, liquid and entrained dust and dirt automatically drain through the openings in the floor of the ramp for separation from the parts and media. The material drained into the underlying compartment can be drawn off for recovery or for disposal.

It will be understood that changes may be made with respect to the manner in which the separating screen is inserted or removed from position of use to effect separation of parts from the media, and that other changes may be made in the construction and arrangement of elements without departing from the spirit of the invention, especially as defined in the following claims.

We claim:

1. The combination of a finishing mill having a substantially annular trough adapted to contain media and parts, means for vibrating the trough to cause media and parts to travel about the trough, a dam extending crosswise of the trough whereby the parts and media rise to a level above normal level in advance of clearance of the dam, the improvement in which the approach to the dam is inclined from the bottom wall of the trough to the apex of the dam, and means to remove fluids, dust, dirt and undersized particles of media comprising passages through the approach dimensioned to be less than the dimension of the parts and media whereby parts and media continue to travel over the approach while the said material fluids, dust, dirt and undersized particles of drains through the openings in the approach, a separate compartment communicating with the underside of the approach to receive the material draining therethrough, and means for removing the said material from the compartment.

2. The combination as claimed in claim 1 in which the approach to the dam is inclined from the bottom wall to the apex at an angle within the range of 15°–40°.

3. The combination as claimed in claim 1 in which the approach to the dam is divided into a lower section and an upper section with the openings through the lower section being of smaller dimension than the openings through the upper section whereby a liquid, dust, dirt and other fine particles drain through the lower section while the upper section is a classifier section for removal of undersized and broken down media.

4. The combination as claimed in claim 3 in which the compartment underlying the approach is divided into two sections corresponding to the upper and lower sections of the approach.

5. The combination as claimed in claim 1 which includes a classifier screen adapted to be positioned immediately beyond the dam for receiving parts and media overflowing the dam, said classifier screen being formed with openings dimensioned to be less than that of the media whereby media is retained on the surface thereof while undersized and broken down media pass therethrough, and a compartment underlying the classifying screen to receive the material passing therethrough while media retained on the surface is returned to the trough.

* * * * *